US009752436B2

(12) United States Patent
Pavetic et al.

(10) Patent No.: US 9,752,436 B2
(45) Date of Patent: Sep. 5, 2017

(54) METHOD AND SYSTEM FOR TUNNEL VENTILATION IN NORMAL CONDITIONS AND IN CONDITIONS OF FIRE

(71) Applicants: Ivor Pavetic, Novo Cice (HR); Svibor Pavetic, Novo Cice (HR)

(72) Inventors: Ivor Pavetic, Novo Cice (HR); Svibor Pavetic, Novo Cice (HR)

(73) Assignees: Ivor Pavetic (HR); Josip Pavetic (HR); Svibor Pavetic (HR)

( * ) Notice: Subject to any disclaimer, the term of this patent is extended or adjusted under 35 U.S.C. 154(b) by 0 days.

(21) Appl. No.: 13/750,822

(22) Filed: Jan. 25, 2013

(65) Prior Publication Data

US 2013/0137356 A1 May 30, 2013

Related U.S. Application Data

(63) Continuation of application No. PCT/HR2010/000026, filed on Jul. 27, 2010.

(51) Int. Cl.
*E21F 1/00* (2006.01)
*E21F 1/08* (2006.01)

(52) U.S. Cl.
CPC ..... *E21F 1/003* (2013.01); *E21F 1/08* (2013.01)

(58) Field of Classification Search
CPC ..... E21F 1/003; E21F 1/008; E21F 1/08
(Continued)

(56) References Cited

U.S. PATENT DOCUMENTS 1,199,485 A * 9/1916 Moran ..... E21F 1/003 454/167
1,409,545 A * 3/1922 Harris ..... 454/166
(Continued)

FOREIGN PATENT DOCUMENTS

CH 433424 A 4/1967
CH 471287 A 4/1969
(Continued)

OTHER PUBLICATIONS

Hitoshi, et al., JP2007-275607A English machine translation, Oct. 25, 2007.*
(Continued)

*Primary Examiner* — Alissa Tompkins
*Assistant Examiner* — Phillip E Decker
(74) *Attorney, Agent, or Firm* — St Onge Steward Johnston and Reens LLC

(57) ABSTRACT

A tunnel ventilation system located in an upper section of a tunnel has a ventilation section divided into two or three ventilation ducts. One or more of the ducts are connected to reversible fan units so the ducts can serve as either an air infeed or an air exhaust system. The ducts contain a series of remotely controlled flaps which can be opened to ventilate different tunnel zones or closed to isolate other parts of the tunnel. Air blowers at tunnel entrances create an air screen that prevents unintended air circulation into the tunnel. Heat, smoke and other sensors and a software control system enable the system to detect smoke and fire, then to isolate and control ventilation in the fire zone. A fire suppression system using low oxygen air or other fire suppression fluids to blanket and smother the fire operates in conjunction with the ventilation system.

19 Claims, 6 Drawing Sheets

(58) Field of Classification Search
USPC ..... 454/166–169, 171, 172
See application file for complete search history.

(56) References Cited

U.S. PATENT DOCUMENTS

| | | | | |
|---|---|---|---|---|
| 1,643,863 | A | 9/1927 | Truax | |
| 1,643,868 | A * | 9/1927 | Woll | 454/167 |
| 1,731,289 | A * | 10/1929 | Blair | 454/167 |
| 2,285,387 | A * | 6/1942 | Bartholomai | 454/167 |
| 2,427,075 | A * | 9/1947 | Singstad et al. | 454/167 |
| 2,740,347 | A * | 4/1956 | Caldwell | 454/167 |
| 2,996,973 | A * | 8/1961 | Boysen | 454/167 |
| 4,200,036 | A * | 4/1980 | Matta et al. | 454/171 |
| 4,907,910 | A * | 3/1990 | Teron | 405/132 |
| 5,466,187 | A * | 11/1995 | Kennedy et al. | 454/169 |
| 6,186,888 | B1 * | 2/2001 | Ohashi | 454/167 |
| 6,401,487 | B1 * | 6/2002 | Kotliar | 62/640 |
| 6,478,672 | B1 * | 11/2002 | Ewald et al. | 454/167 |
| 6,724,917 | B1 * | 4/2004 | Ohashi et al. | 382/104 |
| 7,182,687 | B2 * | 2/2007 | Kennedy et al. | 454/168 |
| 2002/0088250 | A1 | 7/2002 | Kotliar | |
| 2005/0039931 | A1 * | 2/2005 | Koerber | A62C 2/10 169/64 |
| 2006/0172683 | A1 * | 8/2006 | Kennedy et al. | 454/169 |
| 2007/0039744 | A1 * | 2/2007 | Pavesi | 169/49 |
| 2008/0293350 | A1 * | 11/2008 | Hauzer | 454/167 |
| 2009/0038811 | A1 * | 2/2009 | Wagner | A62C 99/0018 169/46 |
| 2009/0042504 | A1 * | 2/2009 | Kumm et al. | 454/167 |
| 2011/0275302 | A1 * | 11/2011 | Tarada | 454/166 |
| 2016/0305244 | A1 * | 10/2016 | Storrosaeter | E21F 1/08 |

FOREIGN PATENT DOCUMENTS

| | | | | |
|---|---|---|---|---|
| CN | 101560881 | A | 10/2009 | |
| DE | 1279055 | B | 10/1968 | |
| DE | 19948885 | A1 | 5/2001 | |
| DE | 10226751 | A1 * | 1/2004 | A62C 3/0221 |
| DE | 10346497 | A1 * | 5/2005 | A62C 2/00 |
| DE | 102007040237 | A1 | 2/2009 | |
| EP | 1112759 | A1 | 7/2001 | |
| EP | 1544408 | A1 | 6/2005 | |
| JP | S5318894 | U * | 2/1978 | |
| JP | 10205299 | A | 8/1998 | |
| JP | 2007275607 | A | 10/2007 | |

OTHER PUBLICATIONS

International Preliminary Report on Patentability Application No. PCT/HR2010/000026 Completed: Jan. 3, 2013 5 pages.

International Search Report Application No. PCT/HR2010/000026 Completed: May 4, 2011; Mailing Date: May 12, 2011 5 pages.

Fells, et al, "Simultaneous measurements of temperature and velocity fluctuations in a double stream-twin jet air curtain for heat confinement in case of tunnel fire"; International Communications in Heat and Mass Transfer; vol. 37, No. 9; Nov. 1, 2010; pp. 1191-1196.

* cited by examiner

METHOD AND SYSTEM FOR TUNNEL VENTILATION IN NORMAL CONDITIONS AND IN CONDITIONS OF FIRE

FIELD OF THE INVENTION

This invention refers to the tunnel ventilation process in normal conditions and in fire conditions and to a tunnel ventilation system in such conditions designed to prevent a longitudinal air flow in the tunnel during a fire as well as to provide fire protection in long tunnels. The invention ensures a stationary air motion in the fire zone with simultaneous fire extinguishing to prevent the spread of fire and smoke in the tunnel outside the fire-affected zone.

BACKGROUND OF THE INVENTION

The problem appearing in tunnels, especially the longer ones, is how to ensure the removal of contaminated gas from the tunnel in an easy and efficient way, combined with quick and efficient fire extinguishing without a spread of smoke into the part of the tunnel not affected by fire. The Invention solves these technical problems by providing a stationary air flow in the tunnel applying a ventilation system and a tunnel ventilation process, where the ventilation section above the horizontal partition is divided by vertical partition walls into three separate ventilation ducts. In the ventilation ducts are flaps, which, unlike the standard shutters, provide perfect sealing. Furthermore, the system consists of a ventilation unit installed in an engine room on tunnel portals, which allows servicing of the unit without interference in current traffic. Due to continuous discharge of contaminated air from the tunnel, the ventilation and ventilation control equipment ensures in both normal operation and fire conditions minimum pollution of the tunnel's walls and ceiling. The tunnel ventilation control system also allows the return of air to where it was drawn out, with a result that no major microclimate changes occur. The system allows installing a purification system to get contaminated gases out of the tunnel. The system as a whole is designed for low energy levels, requiring optimum energy consumption for its operation. If fire breaks out in the tunnel, the system and process according to the invention ensure that fire is confined to a stationary space between two adjacent rows of flaps, whereby one of the main features of the Invention is materialized to the effect that the spread of smoke into the rest of the tunnel is contained, because there is no fresh air motion through the fire; through the flaps smoke is directly carried away via lateral and, if needed, middle ducts, and fresh air comes from both portals to the flaps in front of the fire and, if needed, partly also to the middle duct. Simultaneous with fire signalling and detection of the exact position of fire, air with reduced oxygen content is introduced into the fire section, whereby fire extinguishing takes place. Fresh air motion to the flaps in front of the fire and simultaneous discharge of contaminated air and smoke through at least two ventilation ducts limit the spread of smoke in the tunnel and thereby provide free access for rescuers arriving from any side of the tunnel. Salvage operation is made possible by abandoning the fire zone towards any side and finally the free exit from the tunnel. Apart from fire extinguishing by means of reduced oxygen air, the system allows fire extinguishing by using other agents and systems.

STATE OF THE ART

The CH 433424 document does not describe a 3-duct ventilation along the whole tunnel, only an auxiliary fan at the beginning of the tunnel (FIG. 4). It also describes (row 17-24) the way of achieving aspiration in a fire system that cannot achieve a stationary state in the fire zone. This system cannot prevent the influx of fresh air to the place of fire. The CH 471287 document deals with a suspended ceiling and tie rods that ensure better sealing of the suspended ceiling and tunnel formwork and that are not envisaged for lateral aspiration ventilation ducts (FIG. 1-5). The required protection is based on the design and details of the suspended ceiling and partition walls. The design of the suspended ceiling with vertical girders just bears a certain similarity with our proposed design, but the principle of our ventilation is entirely different from that described in the said document, except for the similarity in using 3 ducts.

The U.S. Pat. No. 1,643,863 document describes transverse ventilation with aspiration ducts mounted above the tunnel portal and with fresh air supply ducts beneath the traffic line. This design likewise does not provide a stationary state at the place where fire has broken out in the tunnel. It bears neither functional nor structural similarity with our new design. The presented 3 ventilation tubes above the profile do not have the same function of ventilation, nor are they a part of the ventilation duct as in the below proffered solution, therefore, as stated in the patent, their number can be more or less than 3.

None of the existing patented tunnel ventilation systems can meet the requirements for passenger and tunnel protection in tunnels of greater length. By their very design they are unable to ensure a stationary state in the fire zone, the feature that constitutes the main advantage of our design. The existing patented solutions do not at all deal with the problem of fire in the tunnel, only with normal ventilation of the tunnel. The solutions lie in bringing fresh air into the tunnel and removing contaminated air produced in traffic.

SUMMARY OF THE INVENTION

What makes the essence of the invention is its ventilation system and process producing a kind of aerodynamics that in a normal operation regime ensures efficacious removal of contaminated air out of the tunnel and in a fire regime ensures efficacious fire fighting for persons found in the fire zone and unimpeded and safe escape of passengers in the tunnel to an area of fresh air, no matter in which direction they move. Also, firemen and rescuers can reach the fire zone together with fresh air. The tunnel ventilation system under the subject Invention provides for a ventilation section above the horizontal partition divided by vertical partition walls into three separate ventilation ducts. Installed in the ventilation ducts are fire-resistant flaps which in an emergency hermetically close the ventilation ducts. Their position is controlled in dependence on measured parameters in the tunnel and whether or not there is fire in the tunnel and, if there is, the position of fire. The engine rooms on the portals accommodate fans which are also operated in dependence on conditions prevailing in the tunnel. Along the tunnel and under the suspended ceiling a system is installed for accurate and rapid detection of conditions in the tunnel, including the location of fire. Furthermore, provision is made for a computer program for monitoring and control of the ventilation system in normal and fire conditions and of fire-fighting itself. The invention also provides for the application of air screen to prevent the influx of air in excess of the designed quantity from the environment into the tunnel, whereby the desired stationary air motion is attained in both normal and fire conditions. The system incorporates a tube-shaped tank that is positioned longitudinally under the carriageway and that contains air with reduced oxygen content in quantity sufficient for fire fighting in 2 sections, where one section represents the space between 2 rows of flaps. In the event of fire, air with reduced oxygen content is brought into the space of the tunnel's fire section. The Invention provides for a tunnel ventilation process in normal and fire conditions. The lateral ventilation ducts serve to ensure continuous aspiration of contaminated air out of the tunnel, whereas the central ventilation duct serves in the conditions of increased/decreased value of measured parameters to bring additional fresh air into the tunnel, and in fire conditions it serves to remove contaminated air and smoke from the tunnel, where in any regime continuous fresh air supply into the tunnel is provided from both portals. Depending on the designed air motion velocity in the tunnel, the capacity and direction of fan operation is controlled and at least one air screen is turned on/off, whereby the influx of the designed air quantity from the environment into the tunnel is controlled and the designed air flow achieved in normal conditions and in conditions of increased/decreased value of measured parameters, as well as a condition of no longitudinal air flow in the event of fire in the fire section. The process includes the positioning of flaps in all three ducts in dependence on the measured conditions prevailing in the tunnel.

BRIEF DESCRIPTION OF THE DRAWINGS

Below is a detailed description of the Invention with reference to the following drawings.

DETAILED DESCRIPTION OF THE INVENTION

Figure 1:
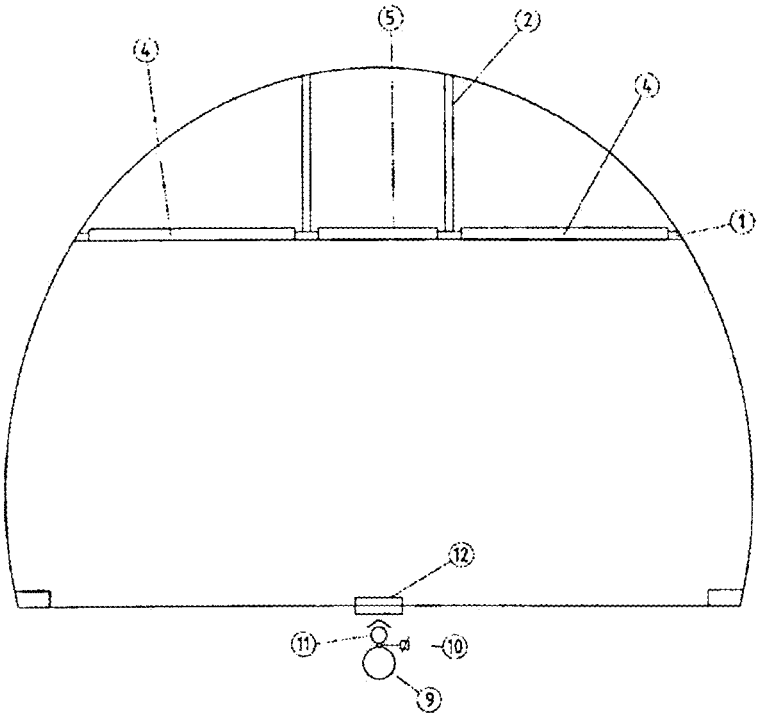
FIG. 1 cross-section of the tunnel.

The tunnel ventilation system involves the use of a suspended ceiling with 2 partitions (2) above it, or 3 ducts with built-in fire-resistant flaps (4) and (5), the dimensions of which ensure a sufficient air intake velocity during aspiration and extend from one to the other lateral side of the duct, virtually from one to the other lateral wall of the tunnel. The flaps (4) in the lateral ducts open up along the longitudinal axis, and the flaps (5) in the middle duct along the axis perpendicular to the longitudinal axis of the duct. All flap drives are placed and can be maintained with the ventilation ducts also while traffic is in progress.

The tunnel ventilation system in normal and in fire conditions, where at a given height the tunnel is divided by a horizontal partition (1) into traffic and ventilation parts, where the system contains a lateral escape passage (16) accessed from the traffic part through a pressure door (15) with springs, where the ventilation part is placed above the horizontal partition (1) and divided by vertical partitions (2) into three separate ventilation ducts, where the ventilation ducts, spaced 50-100 metres along the length of the tunnel, contain built-in rows of flaps (4) and (5), where the system in question further contains a system for the detection of tunnel conditions, a control system with a computer program for monitoring and control of the system in normal and in fire conditions, and at least three fans (3, 3*a*) at the entry to the ventilation ducts on at least one portal. In the lateral escape passage (16) overpressure is provided by one or more fans (14) mounted in the engine rooms on at least one portal of the tunnel; where the system further incorporates a tube-shaped tank (9) placed longitudinally underneath the carriageway, containing air with reduced oxygen content, of capacity sufficient for extinguishing 2 sections, where one section represents the space between 2 adjacent rows of the flaps (4) and (5), where in the event of fire air with reduced oxygen content is brought into the fire-affected section of the tunnel through a latticed duct (12) via explosive valves (10) and a distribution pipe (11); on at least one side of the tunnel the system contains fans (6) generating air screens (6*a*) that prevent the influx of fresh air from the environment into the tunnel in excess of the designed quantity, and sustain the stationary air motion in the tunnel in the event of fire. The fans (3) installed in the lateral ducts are axial/diagonal fitted with a system for separation of solid particles, whereas the fans (3*a*) installed in the middle duct are reversible/axial.

Figure 3:
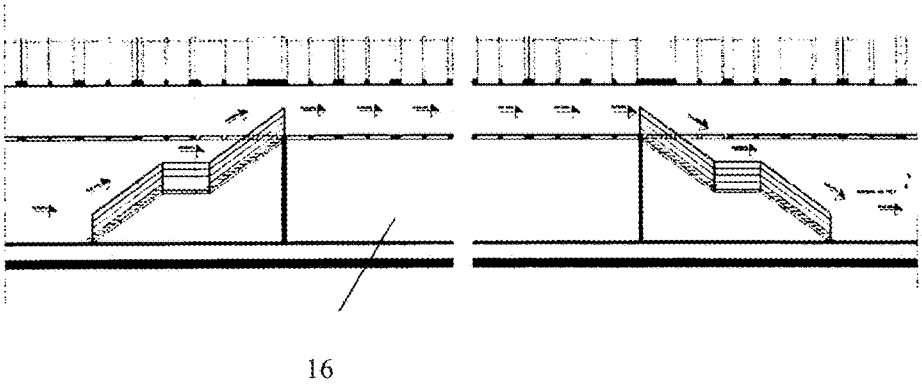
FIG. 3 longitudinal section of the escape passage.
Figure 4:
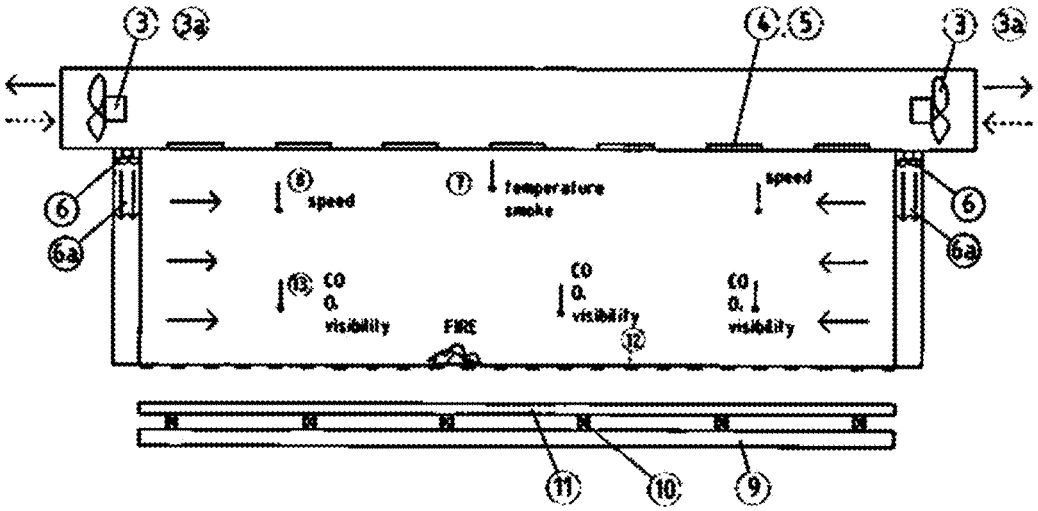
FIG. 4 longitudinal section of the tunnel showing measuring probes and installed equipment, FIG. 5 cross-section of the tunnel and air flow in normal conditions, FIG. 6 cross-section of the tunnel and air flow in fire conditions, FIG. 7 longitudinal section of the tunnel and air motion in fire conditions, FIG. 8 position of flaps in the middle duct and fan operation in the event of fire in the vicinity of one of the portals, FIG. 9 position of flaps in the middle duct and fan operation in the event of fire somewhere in the middle of the tunnel, and FIG. 10 position of flaps in the middle duct and fan operation in the event of fire in any part of the tunnel.
Figure 5:
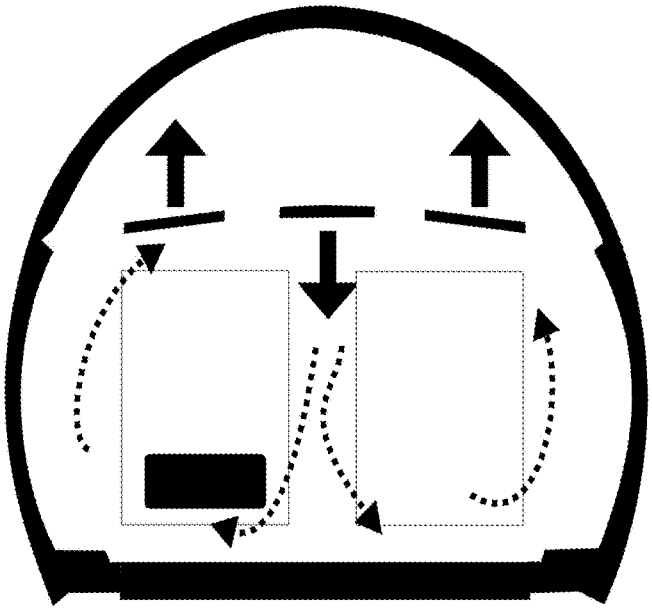
Figure 6:
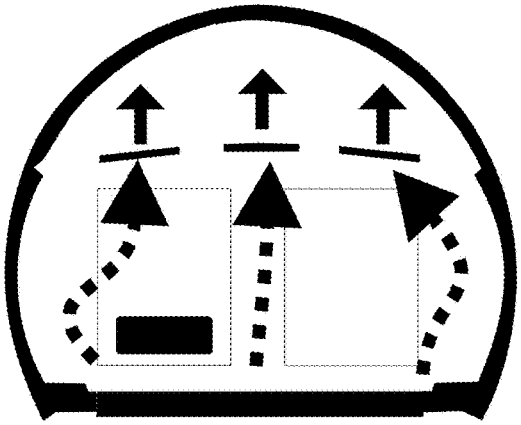
Figure 7:
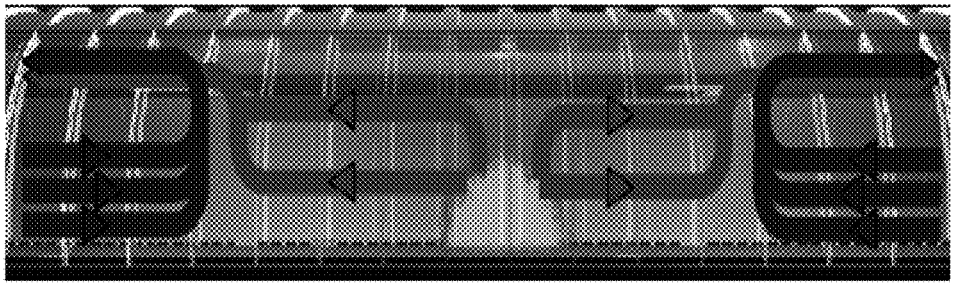
Figure 8:
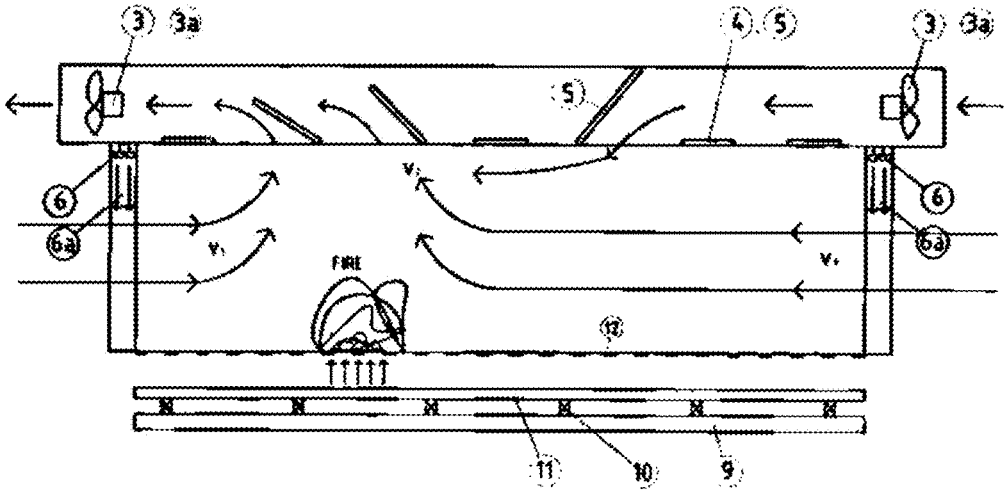
Figure 9:
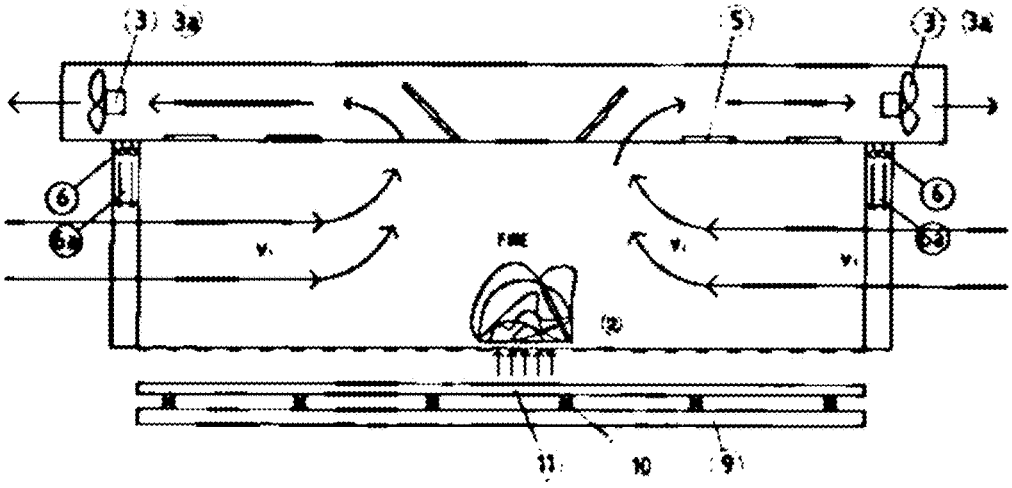
Figure 10:
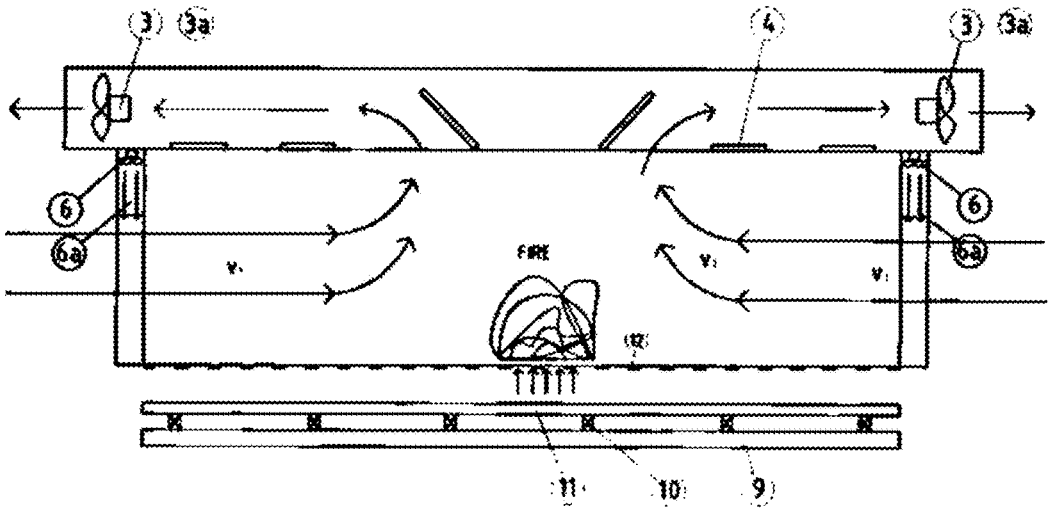

The flaps (4) and (5) are fire-fighting electromotor or hydraulic flaps installed in the horizontal partition (1) in all three ventilation ducts by way of covering the whole width of the ceiling from one side of the tunnel to the other and, when closed, providing perfect sealing, where the flaps (4) in the lateral ducts open up along the longitudinal axis, and the flaps (5) in the middle duct along the axis perpendicular to the longitudinal axis of the duct. The system for the detection of conditions in the tunnel consists of probes (13) for measurement of $O_2$, CO concentrations, chambers and/or sensors for visibility measurement, probes (7) for temperature and smoke measurement, and probes (8) for measurement of air velocity, where through the measured parameters of the probes (13) and the visibility sensors the operation of the fans (3, 3*a*) in the ventilation ducts is controlled, and through the measured parameters of the probes (8) at least one fan (6) is switched on/off to control the air screen (6*a*). Furthermore, the lateral ducts have a larger profile, where all the mentioned ventilation ducts serve to ensure continuous aspiration of contaminated air out of the tunnel and smoke in the event of fire, where the middle duct in normal conditions at a heightened CO concentration and diminished air visibility in the tunnel serves to bring added fresh air into the tunnel. In fire conditions the middle duct serves to remove contaminated air and smoke from the tunnel, where in the event of fire in the section located closer to one of the portals it serves for bringing fresh air. FIG. 1 shows a tunnel cross-section where it can be seen that at a given traffic height the tunnel is divided by the horizontal partition (1) into traffic and ventilation parts. The ventilation part above the horizontal partition is divided by the vertical partitions (2) into three separate ventilation ducts, of which the lateral ducts have a larger and the middle duct a smaller profile. At the entry to the ventilation ducts on each portal at least three fans (3, 3*a*) are installed, where the fans (3), installed in the lateral ducts are axial/diagonal fans, and the fans (3*a*), installed in the middle duct are reversible/axial fans. The fans (3, 3*a*) are mounted in the engine rooms above each portal, where they can be maintained without interrupting traffic in the tunnel. FIG. 3 shows the cross-section of the tunnel and air flow in normal conditions, where the lateral ducts serve for continuous aspiration of polluted air out of the tunnel at minimum level, and fresh air comes as a rule through the portals. In an emergency and in normal conditions, fresh air can be brought through the middle duct. If the $O_2$, CO values or visibility exceed the permissible limits in a certain section of the tunnel, fresh air is injected to that place via the middle duct. Should the CO concentration continue to rise or the visibility continues to diminish, the operation of the lateral fans will be automatically regulated, whereby the lowest possible electricity consumption, combined with highly efficacious tunnel ventilation, is ensured.

Figure 2:
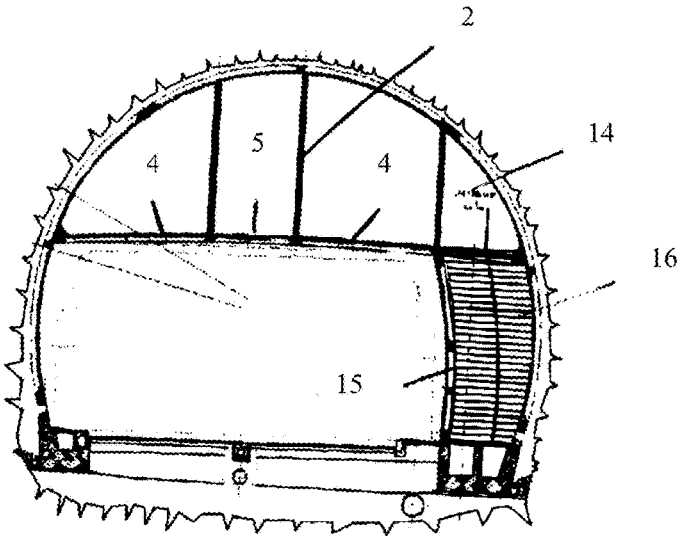
FIG. 2 cross-section of the tunnel with the escape passage.

The middle and lateral ducts contain the installed flaps (4) and (5) which in the event of fire provide perfect sealing, unlike the conventional shutters, a difference that greatly matters in relation to known solutions. Looking at the cross-section, the flaps (4) and (5) are mounted on all three ducts, spaced 50-100 metres along the length of the tunnel. The flaps (4) and (5) are installed in the horizontal partition (1) by way of covering the whole width of the ceiling from one side of the tunnel to the other (see FIG. 1). FIGS. 2 and 3 show the tunnel cross-section with the escape passage (16) and the longitudinal section of the escape passage (16). In the partitioned lateral escape passage (16) overpressure is some 50 Pa, and entries are provided from the tunnel's traffic part through the pressure door (15) with springs at every 250 m. Overpressure is produced by means of the fans (14) mounted in the engine rooms on the tunnel portals. The escape passage (16) replaces an additional service tunnel that for longer two-way tunnels must be built parallel to the road traffic tunnel. Overpressure in the escape passage (16) prevents a possible penetration of contaminated air from the tunnel's road section into the said escape passage (16).

At each of the entries to the tunnel, air screens (6*a*) are created by special fans (6) to prevent air from entering the tunnel in excess of designed quantities. This is very important in areas characterized by strong winds, a great difference in elevations between the portals or diverse weather conditions at the location of the constructed tunnel. Depending on the above mentioned conditions, the air screen (6*a*) may be provided at only one side of the tunnel.

In fire conditions a very important role is played by the ventilation system and rapid detection of the place of fire. After detection of the exact place of fire, all flaps (4) and (5) automatically and hermetically close on all three ducts at both portals, except for the flaps (4) and (5) at the place of fire. The operation of the fans on the portals is controlled by measuring the air velocity (8) before the flaps (4) and (5), thus making sure that there is no longitudinal flow of fresh air (its supply to the place of fire) through the place of fire. The middle duct with the reversible fans takes care of it regardless of which part of the tunnel is affected by a fire incident. The flaps (5) in the middle duct also function as a partition, enabling the middle duct to operate at one side as an aspiratory, at the other side as a feeding system.

Along the tunnel and beneath the suspended ceiling a system is installed for accurate and rapid detection of conditions in the tunnel, including the location of fire. The detection system consists of a probe (13) for measurement of $O_2$, CO concentrations, chambers and/or sensors for visibility measurement, probes (7) for temperature and smoke measurement, and probes (8) for measurement of air velocity. The fans in the lateral ducts are controlled by the $O_2$, CO probe (13) and the visibility sensor, so that the supply of minimum required fresh air quantity coming through the portals is continuously provided and is carried away uniformly. Should the values of measured parameters exceed the permissible limits, as the first step additional fresh air is injected via the middle duct to the respective places. Should the values continue to raise, in the next step the operation of the lateral aspiration fans and thereby the supply of extra fresh air through the portals is intensified. If the values of harmful gases continue to rise, the middle duct will be used for aspiration or feeding. All three ducts will then provide maximum designed air carried away. What we have during any regime is the effect of continuous fresh air motion from the portal into the tunnel. The air velocity probes (8) are installed at every 300 to 500 m to control the fans mounted in the engine rooms on the tunnel portals in order to ensure equal fresh air velocity in normal conditions and in fire conditions. Underneath the carriageway is a tube-shaped tank (9). The tank (9) contains air with reduced oxygen content, of capacity sufficient for extinguishing 2 sections, where one section represents the space between 2 adjacent rows of the flaps (4) and (5). In the event of fire, air with reduced oxygen content is blown via the explosive valves (10) and is brought into the tunnel space through latticed ducts (12), which at the same time send out a sound alarm signalling the moment when a vehicle crosses from one traffic lane to the other. Once the stationary state is reached at the place of fire (where there is no longitudinal air motion), pressurized air with reduced oxygen content is blown, whereby oxygen concentration in the fire zone is reduced to 9-15%, which makes any burning impossible and poses no threat to human lives. The pressurized air with reduced oxygen content is stored in the tank (9) placed longitudinally underneath the tunnel carriageway, of a volume sufficient to put out at least one fire. The pressurized air with reduced oxygen content in the tank (9) is let out via electromagnetic explosive valves (10), a distribution pipe (11) and lattice ducts (12) along the carriageway. The same also serve as a warning to drivers not to cross from one traffic lane to the other.

Mixing of air with reduced oxygen content and the existing air in the fire section occurs instantaneously and fills the whole fire section with the mixture in which the oxygen content ranges from 9 to 15%. Fire may also be extinguished with any other fire-fighting system, however, due to the air motion status in the fire section it is also possible to apply air with reduced oxygen content. The tunnel ventilation process in normal and in fire conditions requires a definition of air quantity needed for tunnel ventilation in normal and in fire conditions. The process involves the use of a suspended ceiling with 2 partitions above it, or 3 ventilation ducts with built-in fire-resistant flaps, the dimensions of which ensure a sufficient air intake velocity during aspiration and extend from one to the other lateral side of the duct, virtually from one to the other lateral wall of the tunnel. The lateral flaps (4) open up along the longitudinal axis, and the middle flap (5) along the axis perpendicular to the longitudinal axis of the duct. All flap drives are placed and can be maintained with the ventilation ducts also while traffic is in progress. The fans are mounted in the engine rooms above each portal, where they can be maintained without interrupting traffic in the tunnel. At 50 m distance from the entry to the tunnel the velocity $v_{2,3}$ of air entering through the portal is measured and, depending on the designed velocity $v_1$, the air screen fans (6) are controlled; the air screens allow entry of fresh air through the portals into the tunnel only up to the designed maximum permissible air quantity $q_{max}$ that the installed fans can remove.

Along the tunnel and under the suspended ceiling a system is installed for accurate and rapid detection of conditions in the tunnel, including the location of fire. The system comprises video surveillance, smoke analysis, thermosensitive cable, etc.

The operation of the fan (3) in the lateral ducts is controlled in dependence on the parameters of the probes (13) for $O_2$, CO and visibility measurement. The fans (3) in the lateral ventilation ducts generate underpressure by which continuous supply of minimum required air quantity coming through the portals is provided. If the value of measured $O_2$ and CO concentrations and measured visibility rises/falls beyond permissible levels, as the first step additional fresh air is injected via the middle duct to the respective places. Should the values continue to rise, in the next step the operation of the lateral aspiration fans (3) and thereby the supply of extra fresh air through the portals is intensified. If the values of harmful gases continue to rise, the middle duct will be used for aspiration or feeding. All three ducts will then provide maximum designed aspirated air. What we have during any regime is the effect of continuous fresh air motion from the portal into the tunnel.

In the conditions of minimum traffic the aspiratory ventilation in the lateral ducts must operate at minimum level and thereby ensure the effect of continuous fresh air motion from the portal into the tunnel at a velocity approximating 0.3 m/s. This is a requirement for the ventilation system, after the location of fire is determined, to fulfil its function very quickly, all due to the underpressure in the lateral ventilation ducts.

The normal and fire ventilation system also prevents a change in microclimate at both sides of the tunnel, because the air flowing into the tunnel returns to the side where it was drawn in.

Due to uniform and continuous aspiration of polluted air through the lateral ducts, the internal walls of the tunnel will remain clean for a prolonged time, which means less cleaning work inside the traffic part of the tunnel. The ventilation ducts can be cleaned during the operation of the ventilation system. High energy efficiency of the system operating in accordance with traffic conditions in the tunnel. The fans are controlled by rpm regulators and they use only the amount of energy needed for effective operation.

As soon as the location of fire is determined, on all three ventilation ducts all the flaps (4) and (5) will close from the portal to the flaps (4) and (5) which are in close proximity to the fire zone and are fully open. In addition to the system for the detection of tunnel conditions, at every 300 to 500 m the air velocity probes (8) are installed which control the fans (3, 3*a*) mounted in the engine rooms on the tunnel portals in a way ensuring equal velocity $v_1$ and $v_2$ of fresh air coming from the portals to the open flaps close to the fire zone. The aspiration capacity of the fans in the engine rooms are changing with the measuring of air velocity in the tunnel. If, looking at the tunnel's longitudinal section, the fire zone is situated asymmetrically, the middle duct will provide sufficient aspiration at the shorter side and at the side farther out will by fresh air facilitate the equalization of the above mentioned air velocities. This is achieved by the design of the flap (5) which during opening causes the partitioning of the middle duct. The flap (5), which is used for that purpose, should be at least so much away from the fire zone that the position of the velocity measurement probe (8) is between the flap and the fire zone.

The system as a whole operates so that the air motion alongside the fire looks like a reverse air screen which does not allow entry of fresh air to the fire zone and the spread of smoke from it. What is achieved is that there is no longitudinal air motion in the fire zone, the fire smoke instead moves towards the open flaps (4) and (5) from both sides. Smoke and fresh air get mixed and are carried away through the ducts via the open flaps (4) and (5) to the fan, whereby it is additionally routed by the closed flaps (4) and (5) which are 100% airtight. While travelling through the ducts, the mixture cools off and is discharged into the atmosphere by the fans (3, 3*a*). It is possible to install filters for purification of the polluted air in both normal and fire conditions. The fans (3, 3*a*), owing to the 100% airtight flaps (4) and (5), need not be dimensioned for an additional air quantity that should otherwise be provided because of the permeability of the usually applied shutters.

Upon closing the flaps (4) and (5) from the portals to those in immediate proximity the fire zone, fire is isolated and extinguishing can go ahead. Due to the stationary state in the fire zone between two adjacent rows of flaps, it is possible to apply extinguishing by means of air with reduced oxygen content. Air with reduced oxygen content in the tube-shaped tank (9) is positioned underneath the carriageway in the whole length of the tunnel. The capacity of the tank (9) suffices for fire fighting in 2 sections. One section is a space between 2 adjacent rows of the flaps (4) and (5). Air with reduced oxygen content is brought through the latticed ducts (12), which at the same time send out a sound alarm signalling the moment when a vehicle crosses from one traffic lane to the other. Mixing of air with reduced oxygen content with the existing air in the fire section occurs instantaneously and fills the whole fire section with the mixture, the oxygen content of which ranges from 9 to 15%. Fire may also be fought with any other fire-fighting system.

The ventilation and fire-fighting process in normal and in fire conditions defines through the system the maximum permissible designed air quantity $q_{max}$ for tunnel ventilation in normal conditions and in fire conditions, where the process involves:

- measurement of air velocity v at maximum distance of 50 m from the entry to the tunnel, and switching of the air screens (6*a*) on and off by means of the fan (6) allowing entry of fresh air through the portals into the tunnel only up to the designed maximum permissible air quantity $q_{max}$ that the installed fans (3, 3*a*) can remove, and
- simultaneous measurement of air velocity v in the tunnel at every 300 to 500 metres, where, depending on the air velocity v, the probes (8) control the operation capacity of the fans (3) and (3*a*) mounted in the engine rooms on the tunnel portals, and
- simultaneous measurement of $O_2$, CO values and air visibility in the tunnel by means of the probes (13), where the probes (13) control the fans (3) and (3*a*), and, depending on the values of the measured parameters, uniform aspiration of air out of the tunnel by means of the lateral ventilation ducts, whereby the supply of minimum required fresh air quantity is continuously provided through the portals,
- temperature and smoke measurement by means of the probes and detection of the location of fire conditions, and
- control of the opening of the flaps (4) and (5) in the ventilation ducts in dependence on the measured temperature and smoke parameters where all the mentioned previous steps are functionally interconnected in a way that in the tunnel the designed air velocity $v_2$ is established whether in normal or in fire conditions; where the lateral ventilation ducts serve for continuous removal of contaminated air from the tunnel or of smoke in the event of fire; where the middle ventilation duct, in the conditions of higher/lower $O_2$, CO concentration and diminished air visibility in the tunnel, serves to bring into the tunnel additional fresh air, whereas in fire conditions serves to remove polluted air and smoke from the tunnel, where in the event of fire in a section closer to one of the portals serves to supply air; where in both normal and fire conditions continuous fresh air supply is provided from the portals to the tunnel, where in fire conditions air is brought from the portals to the flaps (4) and (5) placed close to the fire-affected section of the tunnel. If at a certain place in the tunnel the values of measured parameters are outside the permissible limits, as the first step additional fresh air is injected via the middle duct to the respective place; should the values continue to depart from the permissible limits, in the second step the operation of the lateral aspiration fans (3) and thereby the supply of extra fresh air through the portals is intensified; should the values continue to depart from the permissible limits, in the third step the middle duct will perform the aspiratory function. The measured parameters are oxygen concentration, CO, air visibility, air velocity v, temperature, smoke and exhaust gas concentration, as well as any combinations of two or more parameters.

After detection of the exact place of fire, all flaps (4) and (5) automatically and hermetically close on all three ducts at both portals, except for the flaps (4) and (5) at the fire. After detection of fire conditions in a section nearer to one of the portals, the flap (5) in the middle ventilation duct will hermetically close the duct profile, where the said flap (5) is at least so much away from the fire zone that the air velocity measurement probe (8) is placed between the flap (5) and the fire, whereas the other flaps (5) in the middle duct are down and the fans (3*a*), which are farther away from the fire zone, operate in such a way that they bring fresh air, whereas the fans (3*a*) nearer to the fire zone operate in such a way that they carry air and smoke away from the fire zone, where the fans (6) of the air screens (6*a*) start operating if air velocity v on at least one of the portals rises beyond the designed velocity $v_2$. After detection of fire conditions in a section nearer to the middle of the tunnel, the adjacent flaps (5) bounding the fire zone will close the duct profile in such a way that they will direct the air and smoke flow through the middle ventilation duct towards the tunnel exit, whereas the other flaps (5) in the middle duct are down, and the fans (3*a*) on both portals operate by way of carrying air and smoke away from the fire zone, where the air screen (6*a*) starts operating if air velocity v on at least one of the portals rises above the designed velocity $v_2$. In the lateral ducts, after detecting fire conditions in any area of the tunnel, the adjacent flaps (4) bounding the fire zone will restrict the profile of the lateral ducts by way of directing the air and smoke flow through the middle ventilation duct towards the tunnel exit, whereas the other flaps (5) in the middle duct are down, and the fans (3*a*) on both portals operate by way of carrying air and smoke away from the fire zone, where the air screen (6*a*) starts operating if air velocity v on at least one of the portals rises above the designed velocity $v_2$.

Once fire has been isolated, between two adjacent rows of the flaps (4) and (5) pressurized air with reduced oxygen content is simultaneously brought from the tank (9) into the fire zone through the latticed duct (12) via the explosive valves (10) and the distribution pipe (11), where the mixing of air with reduced oxygen content and thereby fire extinguishing occurs instantaneously. Fire fighting can be performed with any other agent suitable for the purpose.

The operation capacity and direction of the fans (3, 3*a*) is controlled by measuring the air velocity v and the $O_2$, CO concentrations and air visibility in the tunnel in dependence on the designed air velocity $v_2$ and at least one air screen (6*a*) is switched on/off, whereby the influx of the designed air quantity from the environment into the tunnel is regulated and the designed air motion is achieved in normal conditions, in the conditions corresponding to the values of the measured parameters outside the permissible limits and in fire conditions prevailing in the fire zone. In the fire zone, after attaining the positions of the adjacent flaps (5) in a way that they close the middle duct or direct the air flow in all three ventilation ducts and by regulating the operation capacity and direction of the fans (3, 3*a*) and switching on/off at least one air screen (6*a*), a state without longitudinal air motion in the fire zone will be achieved. The above described fire ventilation process ensures efficacious fire fighting for persons found in the fire zone and unimpeded and safe escape for passengers in the tunnel to an area of fresh air, no matter in which direction they move. Firemen and rescuers can thus reach the fire zone together with fresh air.

What is claimed is:

1. A ventilation system for a tunnel in a fire condition comprising:

an upper ventilation portion having one or more longitudinal ventilation ducts;

one or more ventilation fans positioned to move air and/or smoke through said ventilation ducts;

a lower traffic portion of the tunnel;

the lower traffic portion of the tunnel having a plurality of fire zones, said fire zones being isolatable by providing a stationary air zone at a fire zone during a fire condition by selective opening of flaps covering openings between the lower traffic portion of the tunnel and the ventilation ducts, the flaps being located in a spaced relationship adjacent to the fire zone having a fire condition, whereby air and/or smoke is removed from the tunnel through the openings into the ventilation ducts and longitudinal motion of fresh air through the tunnel and into the fire zone having a fire condition is reduced by removing incoming fresh air through the openings into the ventilation ducts prior to reaching the fire zone;

one or two tunnel terminal ends, having one or more portal fans located at one or both tunnel terminal ends, the portal fans providing an air screen at the tunnel terminal ends, the portal fans being activated to provide the air screen at the tunnel terminal ends to prevent entry of fresh air from outside the tunnel into the lower traffic portion of the tunnel in excess of a predetermined maximum quantity of fresh air entry wherein the tunnel remains substantially unobstructed between its ends in the fire condition when operation of the flaps creates the stationary air zone and when the one or more portal fans are activated;

air velocity sensors positioned in the lower traffic portion of the tunnel;

operation of said portal fans being controlled in response to air velocities determined by the air velocity sensors.

2. The ventilation system of claim 1 wherein the predetermined maximum quantity of fresh air entry is based on a maximum quantity of air and/or smoke that said ventilation fans can remove from said tunnel.

3. The ventilation system of claim 1 wherein the one or more portal fans direct air downwardly along a vertical path to generate the air screen.

4. The ventilation system of claim 1 further comprising:

a supply of low oxygen gas which is directed a fire zone during a fire condition.

5. The ventilation system of claim 1 further comprising:

probes positioned in the lower portion and measuring $O_2$, CO or visibility in the tunnel;

said one or more ventilation ducts including a longitudinal duct for removing the smoke and air from the tunnel and a longitudinal duct for providing fresh air into the tunnel; each of the ventilation ducts being associated with a ventilation fan, one of;

a plurality of rows of flaps, each row including at least two flaps;

a control system for operating the flaps, portal fans, and ventilation fans in response to the $O_2$, CO or visibility measured by the probes.

6. The ventilation system of claim 5 wherein when an $O_2$ value is less than a desired value, fresh air is provided through one or more of the ventilation ducts through the openings into the tunnel to increase the $O_2$ value.

7. The ventilation system of claim 5 wherein when a CO value is greater than a desired value, air is removed from the tunnel through the openings to one of the ventilation ducts to reduce the CO value.

8. The ventilation system of claim 5 wherein when a visibility value is less than the desired value, air is removed from the tunnel through the openings to one of the ventilation ducts to increase the visibility value.

9. The ventilation system of claim 1, wherein:

a first one of said air velocity sensors is located 50 meters or less from an entry to the tunnel; and additional air velocity sensors are positioned every 300 to 500 meters within the tunnel.

10. The ventilation system of claim 9 wherein the maximum quantity of fresh air entry is based on a maximum quantity of air and/or smoke that said ventilation fans can remove from said tunnel.

11. The ventilation system of claim 1, further comprising:

a plurality of probes for measuring $O_2$, CO, visibility, temperature and smoke values are located in said tunnel.

12. The ventilation system of claim 11, wherein said ventilation fans and flaps are activated based on probe measurements.

13. A method for controlling a fire in a tunnel having tunnel terminal ends comprising:

monitoring a lower portion of the tunnel with a plurality of probes positioned in the tunnel and spaced apart from each other;

detecting a fire condition in a fire zone based on an increase in at least one value measured in one of the probes;

identifying a location of the fire zone fire based on a location of the probe and identifying at least two flaps adjacent the fire zone, each one of the at least two flaps positioned on either side of the fire zone, the flaps being located in openings between a ventilation duct and the lower portion of the tunnel;

opening the at least two flaps;

activating a ventilation fan associated with the ventilation duct to provide a stationary air zone at the fire zone during the fire condition wherein air and/or smoke is removed from the tunnel through the openings into the ventilation ducts and longitudinal motion of fresh air through the tunnel and into the fire zone having a fire condition is reduced by removing incoming fresh air through the openings into the ventilation ducts prior to reaching the fire zone;

activating one or more portal fans located at one or both tunnel terminal ends to provide an air screen at the tunnel terminal ends to prevent entry of fresh air from outside the tunnel into the lower portion of the tunnel in excess of a predetermined maximum quantity of fresh air entry wherein the tunnel remains substantially unobstructed between its ends in the fire condition when operation of the flaps and the ventilation fan creates the stationary air zone and when the one or more portal fans are activated;

wherein air velocity sensors are positioned in the lower traffic portion of the tunnel and operation of said portal fans is controlled in response to air velocities determined by the air velocity sensors.

14. The method of claim 13 wherein the predetermined maximum quantity of fresh air entry is based on a maximum quantity of air and/or smoke that said ventilation fans can remove from said tunnel.

15. The method of claim 13 further comprising introducing a fire extinguishing agent into the lower portion of the tunnel.

16. The method of claim 15 wherein the fire extinguishing agent is introduced via a valve positioned between the at least two flaps.

17. The method of claim 15 wherein the fire extinguishing agent comprises a supply of low oxygen gas.

18. The method of claim 13 wherein:

said plurality of probes measure one or more of an $O_2$ value, a CO value, or an air visibility value;

said ventilation duct includes a longitudinal duct for removing the smoke and air from the tunnel and a longitudinal duct for providing fresh air into the tunnel, each of the longitudinal ducts being associated with a ventilation fan;

a plurality of rows of flaps, each row including at least two flaps;

a control system for operating the flaps, portal fans, and ventilation fans in response to the $O_2$, CO or visibility measured by the probes;

wherein when an $O_2$ value is less than a desired value, fresh air is provided through one or more of the ventilation ducts through the openings into the tunnel to increase the $O_2$ value;

wherein when a CO value is greater than a desired value, air is removed from the tunnel through the openings to one of the ventilation ducts to reduce the CO value;

wherein when a visibility value is less than the desired value, air is removed from the tunnel through the openings to one of the ventilation ducts to increase the visibility value.

19. The method of claim 13 wherein an air velocity sensor is located 50 meters or less from an entry to the tunnel; and additional air velocity sensors are positioned every 300 to 500 meters within the tunnel.

* * * * *